US010616694B2

(12) United States Patent
Kamkar-Parsi et al.

(10) Patent No.: US 10,616,694 B2
(45) Date of Patent: Apr. 7, 2020

(54) METHOD FOR OPERATING A HEARING DEVICE AND HEARING DEVICE FOR DETECTING OWN VOICE BASED ON AN INDIVIDUAL THRESHOLD VALUE

(71) Applicant: SIVANTOS PTE. LTD., Singapore (SG)

(72) Inventors: Homayoun Kamkar-Parsi, Erlangen (DE); Marko Lugger, Hirschaid (DE); Tobias Rosenkranz, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 16/124,493

(22) Filed: Sep. 7, 2018

(65) Prior Publication Data

US 2019/0020957 A1 Jan. 17, 2019

Related U.S. Application Data

(63) Continuation of application No. PCT/EP2017/055613, filed on Mar. 9, 2017.

(30) Foreign Application Priority Data

Mar. 10, 2016 (DE) ..... 10 2016 203 987

(51) Int. Cl.
*H04R 25/00* (2006.01)
*G10L 25/78* (2013.01)

(52) U.S. Cl.
CPC ..... *H04R 25/43* (2013.01); *H04R 25/505* (2013.01); *H04R 25/70* (2013.01);
(Continued)

(58) Field of Classification Search
CPC . H04R 25/00; H04R 2225/49; H04R 2460/01
(Continued)

(56) References Cited

U.S. PATENT DOCUMENTS 7,340,231 B2 3/2008 Behrens et al.
8,873,779 B2 10/2014 Lugger
(Continued)

FOREIGN PATENT DOCUMENTS

DE 102011087984 A1 6/2013
EP 2242289 A1 10/2010
(Continued)

*Primary Examiner* — Suhan Ni
(74) *Attorney, Agent, or Firm* — Laurence A. Greenberg; Werner H. Stemer; Ralph E. Locher

(57) ABSTRACT

A method operates a hearing aid where a sound is recorded by a microphone. The sound is analyzed with respect to the correspondence thereof with the own voice of the hearing aid wearer and a characteristic value is produced, which indicates how strongly the sound corresponds with the own voice. The own voice is a sound type. The characteristic value is compared with a threshold value and, depending on whether the characteristic value lies above or below the threshold value, the sound is identified as the own voice. Depending on whether the sound has been identified as the own voice, the hearing aid is switched among a plurality operating modes. The method is characterized in that the threshold value is set in accordance with the user. Thus, an improved own-voice identification recognizer is formed, which distinguishes the own voice of the hearing aid wearer from another sound type.

10 Claims, 2 Drawing Sheets

(52) U.S. Cl.
CPC .... *G10L 2025/783* (2013.01); *H04R 2225/41* (2013.01); *H04R 2225/43* (2013.01); *H04R 2225/61* (2013.01)

(58) Field of Classification Search
USPC ..... 381/312, 316–317, 320
See application file for complete search history.

(56) References Cited

U.S. PATENT DOCUMENTS

| | | | |
|---|---|---|---|
| 2011/0261983 | A1 | 10/2011 | Claussen et al. |
| 2013/0148829 | A1 | 6/2013 | Lugger |
| 2014/0088966 | A1 | 3/2014 | Harada et al. |
| 2017/0256272 | A1 | 9/2017 | Kamkar Parsi et al. |
| 2017/0272871 | A1 | 9/2017 | Giese et al. |

FOREIGN PATENT DOCUMENTS

| | | | |
|---|---|---|---|
| EP | 2381702 | A2 | 10/2011 |
| EP | 2991379 | A1 | 3/2016 |
| WO | 2016078786 | A1 | 5/2016 |

METHOD FOR OPERATING A HEARING DEVICE AND HEARING DEVICE FOR DETECTING OWN VOICE BASED ON AN INDIVIDUAL THRESHOLD VALUE

CROSS-REFERENCE TO RELATED APPLICATION

This is a continuation application, under 35 U.S.C. § 120, of copending international application No. PCT/EP2017/055613, filed Mar. 9, 2017, which designated the United States; this application also claims the priority, under 35 U.S.C. § 119, of German patent application No. DE 10 2016 203 987.3, filed Mar. 10, 2016; the prior applications are herewith incorporated by reference in their entirety.

BACKGROUND OF THE INVENTION

Field of the Invention

The invention relates to a method for operating a hearing device, wherein a sound is recorded by a microphone, the sound is analyzed with regard to its similarity with the wearer's own voice of the hearing device wearer, and a feature value is generated that indicates the extent to which the sound is similar with the wearer's own voice of the hearing device wearer. The wearer's own voice is a sound type, the feature value is compared with a threshold value, the sound is detected as own-voice depending on whether the feature value is above or below the threshold value. The hearing device is switched among a plurality of operating modes depending on whether the sound was recognized as the wearer's own voice. The invention additionally relates to a hearing device.

A corresponding method is described, for example, in the applicant's unpublished international application with file reference PCT/EP 2015/068796, corresponding to U.S. patent publication No. 2017/0256272 A1.

In the context of an analysis of the sounds recorded by means of one or more microphones, it is possible to recognize the wearer's own voice of the hearing device wearer and to switch the hearing device between different operating modes based on that recognition. Such an analysis is also referred to as "own voice detection", or OVD for short. Such an analysis is carried out by means of an own-voice recognizer, which is usually a component of the hearing device. The microphone converts the sounds into electrical signals, which are then examined to assign the sound to a particular sound type, and more particularly, to decide whether or not the original sound is the wearer's own voice, i.e. whether the hearing device wearer is speaking or not.

From U.S. patent publication No. 2011/0261983 A1, a method is known for own-voice recognition, in which a predetermined threshold value for the recognition of the wearer's own voice is selected based on ambient sound. For this purpose, different threshold values are initially set for different sound classes among ambient sounds. During normal operation, i.e. during use of the hearing device by the hearing device wearer, the threshold value is selected based on the sound class currently present.

In the above-cited application PCT/EP2015/068796, the analysis is carried out using special filters, each of which has its own filter profile that is adapted to a respective sound, i.e. to a specific sound type or sound class. A given signal is then filtered by the filters. From the resulting filtered signal, it is then determined, for each of the filters, to what extent the original sound corresponds to the sound type to which the respective filter is adapted. For this purpose, the filter profiles are designed, for example, such that the sound to be detected is maximally attenuated based on the filter profile. In the above-mentioned application, a distinction is made in this way, according to the location of the sound, i.e. sounds which arise at different points in space relative to the hearing device are influenced differently by a respective filter. As a result, a spatial distinction, and also a distinction as to sound type, may be made due to the position of the sound relative to the hearing device. For example, nearby sounds are recognized as spatially close and then presumed to be the user's own voice, while distant sounds are recognized as such and are then presumed to be a foreign voice. Greater similarity between the actual sound and the sound to which the filter is adapted results in greater attenuation and higher degree of similarity, i.e. a higher probability that the sound being examined matches the sound type assigned to the filter. In this way, sounds may be correctly classified with a certain probability, and may be assigned to one of in particular a plurality of different sound types.

Applying different filters to a recorded signal results in correspondingly different values for the attenuation, i.e. generally similarity values, so that it is possible to decide based on these values which sound type it is. If the hearing device wearer is speaking, then the signal is attenuated more strongly by this filter and the result is a higher similarity score than in the case of another filter that is adapted, for example, to a foreign speaker in front of the hearing device wearer. By evaluating the two values, it may then be reliably determined that the hearing device wearer is speaking, i.e. that an own-voice situation is present. The evaluation takes place by forming a feature value, for example by forming a difference or quotient of the two values for the attenuation, and subsequently comparing the feature value with a predetermined stored threshold value or limit value.

SUMMARY OF THE INVENTION

Against this background of the prior art, it is an objective of the invention to specify a method for operating a hearing device, in which the distinction between the hearing device wearer's own voice and other sounds is made more reliably. In addition, a corresponding hearing device with improved own-voice recognition is provided.

The objective is achieved according to the invention by means of a method having the features of the main method claim and a hearing device having the features of the main apparatus claim. Advantageous configurations, developments and variants are the subject matter of the dependent claims. The explanations made in connection with the method also apply analogously to the hearing device, and vice versa.

The method is used to operate a hearing device. A "hearing device" generally means a device for outputting sound by a loudspeaker, with the sound being obtained from sounds that have been recorded from the environment by at least one microphone. The sounds are converted by the microphone into electrical signals and are processed by a control unit in the hearing device. The signals are then converted back into sounds via the loudspeaker and are output. In particular, a "hearing device" refers to a device for the care of a hearing-impaired person or person with hearing loss who, in particular, wears the hearing device continuously or most of the time in order to compensate for a hearing deficit. The hearing device thus has a total of at least one microphone, a loudspeaker, also referred to as a receiver, and a control unit; the control unit controls the recording and output of sound. Usually, the control unit is configured at least for amplifying sounds.

In the method of the invention, a sound is recorded by the microphone. The sound, or more precisely the electrical signal generated from the sound, is analyzed with regard to its similarity with the hearing device wearer's own voice, and a feature value is generated that indicates how closely the sound matches the hearing device wearer's own voice. The wearer's own voice, here, is one sound type in particular from among a plurality of different sound types.

The feature value is preferably generated by a classifier. A classifier analyzes a recorded sound with regard to a number of characteristic features of a particular sound type, and provides the feature value as a measure of the sound's similarity with the sound type. The feature value is then compared with a threshold value. Depending on whether the feature value is above or below the threshold value, the sound is recognized as the wearer's own voice, i.e. is unambiguously assigned to the "own voice" sound type. In this respect, the comparison with the threshold value is a decision-making procedure for determining which feature values arise from the presence of the wearer's own voice and, when the wearer's own voice is deemed to have been recognized.

The analysis of the sound, the generation of the feature value, the comparison with the threshold value and the decision whether the wearer's own voice is present or not, are all carried out by an own-voice recognizer, which is a component of the hearing device and is implemented, for example, as an integrated circuit. In this case, the own-voice recognizer may be part of the control unit of the hearing device or may be configured as a separate unit. Depending on whether the sound has been recognized as the wearer's own voice, the hearing device is switched among a plurality of operating modes, for example as an own-voice mode and a non-own-voice mode. The switching is done automatically, i.e. by the hearing device itself, in particular by the control unit or directly by the own-voice recognizer.

According to the invention, the threshold value is set user-dependently and as an individual threshold value.

User-dependent determination of an individual threshold value means that the threshold value is set based on the hearing device wearer's identity. In particular, no feature values from other hearing device wearers/users are used for determining the threshold value.

The setting is done either by the acoustician in the context of a fitting session, by the hearing device wearer himself or herself, or automatically by the hearing device in normal operation, i.e. online. By adapting the threshold value used for the comparison to the user, a potentially strongly deviating feature value is optimally incorporated in the determination, and in particular classification, of the wearer's own voice. It is also reasonable to specially adapt the generation of the feature value itself, as described above, to the hearing device wearer, in order to achieve a particularly optimal recognition of the wearer's own voice.

For user-dependent, individual setting, the threshold value is determined by means of a calibration procedure in which, in particular, the wearer's own voice of the hearing device wearer is recorded several times and a plurality of individual, i.e. user-specific, feature values are generated. Finally, during the calibration procedure, the individual threshold value is set based on the individual feature values that have been generated. In this way, a particularly suitable and user-optimal threshold value is set. Consequently, a multiplicity of individual feature values are generated, so that a distribution of the individual feature values is obtained, and the threshold value is then determined based on that distribution.

By setting the threshold value with respect to a feature value of the distribution, for example as a $2\sigma$ deviation from the mean, or generally such that the generated feature values are predominantly above or below the threshold value, the threshold value is thus set based on the individual feature values generated in the calibration procedure.

This configuration is based on the recognition that the threshold value may be highly user-dependent. Especially in the case of the above-described method taken from PCT/EP2015/068796, the attenuation values generated by the filter used may have considerable user-dependent variation. A fixed threshold value would therefore result in the wearer's own voice being recognized for one user, but recognized as a foreign voice for the other user, even though it was the user's own voice in both cases.

This configuration is also based on the consideration that both the wearer's own voice and foreign voices/ambient sounds are recorded during the course of the calibration procedure. Therefore, feature values are obtained in the presence of the wearer's own voice, as well as in the presence of a foreign voice/ambient sound. The overall distribution of the feature values thus shows a spectrum of possible feature values. From this distribution, the individual threshold value is determined, for example, by statistical methods, in particular averaging.

This is based in particular on the knowledge that a feature value used for identifying a sound and assigning it to a sound type may vary considerably from one environment to another. In other words, in different environments for the hearing device, a sometimes greatly changed feature value may be generated upon the detection of a specific sound, because the sound as recorded has been changed, distorted or superposed by other sounds. In this case, the term "environment" should be interpreted from the standpoint of the hearing device, not the hearing device wearer. In particular, logically, the hearing device wearer's own voice differs from user to user, so that different hearing device wearers will also represent different environments for the hearing device. But other sounds, i.e. external sounds with respect to the hearing device wearer such as foreign voices, may lead to different feature values in different environments.

"Sound" generally refers to sound signals of any type that are in the audible frequency range. Different sound types include the wearer's own voice, a foreign voice, sounds, tones, music, interference and noise.

The method according to the invention is additionally based on the consideration that a decision of own-voice recognition due to a fixedly predetermined threshold value is potentially highly error-prone. To reduce the error in determining the type of a sound, it is possible, as a general matter, to deliberately set the threshold value to be very high or very low. Thus, although the error rate may be reduced in the erroneous recognition of sounds other than the wearer's own voice as own-voice sounds, or, conversely, the non-recognition of the wearer's own voice when it is present, overall, this approach is inadequate because the correct recognition or non-recognition of the wearer's own voice is limited to particularly clear cases, and the particularly environment-dependent range of feature values is thereby largely excluded.

'User-dependent setting of the threshold value" means, in particular, that no generally predetermined threshold value is used by the own-voice recognition for decision-making.

Instead, the respective suitable threshold value is selected in particular by a preceding environmental analysis. In this case, for example, the current environment is first of all suitably determined by the own-voice recognition itself or by the control unit, and then the assigned threshold value that is optimal for the environment is selected from a group of threshold values and set.

A prior determination of the specific threshold value to be used for this particular situation should be distinguished from the above-described, environment-dependent setting of the threshold value during operation. This determination is made either when setting the hearing device, for example as part of a fitting session at the acoustician, or alternatively or additionally by the actual hearing device wearer. Automatic determination in a special calibration mode, or during normal operation of the hearing device, is also possible in principle. In general, the determination creates an assignment of threshold values to environments so that there is a group of threshold values to choose from, and the most suitable one of these is then selected. This assignment is expediently stored in a memory of the hearing device, in particular the control unit, for example as a table, a functional assignment or a user profile. According to this arrangement, therefore, not only is a predetermined threshold value stored, but a plurality of predetermined threshold values are stored for different environments. From a plurality of predetermined threshold values, a suitable threshold value is then selected and set according to the environment, and as a result, the selection of the operating mode of the hearing device during operation is significantly less error-prone.

The user-dependent setting of the individual threshold value is further to be distinguished from the setting of the determination of a feature value, for example a setting of the aforementioned filter or a classifier, which is used to analyze sounds and generate a feature value. Consequently, the threshold value does not serve to determine the feature value but to evaluate the already determined feature value. Such a configuration of those components that generate the feature values takes place, in particular, independently of the user-dependent or environment-dependent selection and setting of the threshold value for evaluation of the feature value. Expediently, however, these components are also set user-dependently. This is sensible, for example, with regard to own-voice recognition, i.e. the detection of the hearing device wearer's voice, i.e. the generation of the feature value, for example by a filter, is expediently adapted to the voice of the hearing device wearer, in order to ensure optimal feature value generation and thus optimal distinguishability from other sound types.

In a suitable development, the threshold value is calibrated by determining a maximum and a minimum feature value over a limited period of time and setting the threshold value between the minimum and the maximum feature value. This is based in particular on the assumption that at the maximum feature value, the sound has the "own voice" sound type, and at the minimum feature value, it has the "foreign voice" sound type. However, depending on the calculation of the feature value, this may also be reversed: in that case, it is assumed that the wearer's own voice generates a minimum feature value and the foreign voice generates a maximum feature value. The limited period is usually between several seconds and a few tens of seconds, for example, about 20 seconds. The maximum and minimum feature values, accordingly, are the short-term extrema within this period. Through the continuous determination of short-term extrema, the feature values that are typical over a much longer period than the limited period are determined for the wearer's own voice and also for another sound type, in particular a foreign voice. In this way, statistical distributions that are at least similar are advantageously obtained as in the above-mentioned calibration procedure, in which at least the presence of the wearer's own voice must be particularly known. In the present case, on the other hand, it is in particular essentially advised when the recorded sound is the wearer's own voice and when is another sound type, based on the minimum and maximum feature values within a limited period of time.

In an advantageous configuration, the threshold value is calibrated in normal operation by the individual feature values being determined recurrently and the threshold value being set on that basis. As a result, the threshold value is adjusted continuously so that the threshold values that have been stored in the course of the assignment approach optimal threshold values over time.

The calibration does not correspond to the environment-dependent setting of the threshold value, which is set in a specific situation. Rather, during calibration, the threshold value that has been stored for a respective range is adjusted, and is then set. In this sense, the recurrent re-calibration of the threshold value of a range is a continuous online optimization of the own-voice recognition. This optimization takes place either continuously or only at specific times, or solely over a single specified period of time.

In an advantageous configuration, the sound is also additionally analyzed with regard to its similarity with at least one other sound type, in addition to the wearer's own voice. In each case, for example, a similarity value is generated that indicates how closely the sound matches a specific sound type, and the match values are then combined into the feature value. One of the at least two sound types is the wearer's own voice. As a result, a distinction between the wearer's own voice and the other sound type is realized with respect to the feature value. This distinction is significantly improved by the threshold value that is set environment-dependently. The feature value is for example the difference or quotient of the two similarity values.

In a preferred variant, the distinction between the wearer's own voice and another sound type corresponds to the distinction between local, i.e. spatially separated sounds. The wearer's own voice is usually the sound type that is closest to the hearing device in spatial terms, so that a distinction is made between the wearer's own voice and another sound type in a simple manner through spatial differentiation, i.e. differentiation according to the location of the sound.

In a preferred development, the other sound type is a foreign voice, which is arranged in particular frontally with respect to the hearing device wearer. In particular, a foreign voice does not mean the voice of a specific other person, but rather a voice which is not the voice of the hearing device wearer. By means of the own-voice recognition, a distinction is then made between the wearer's own voice and a foreign voice.

In a particularly preferred embodiment, the feature value is generated as in the aforementioned international application PCT/EP 2015/068796, by a filter pair, wherein one of the filters is configured for maximum attenuation of the wearer's own voice and the other filter for a maximum attenuation of a foreign voice, in particular a foreign voice that comes from a person directly in front of the hearing device wearer. The two filters each provide a similarity value in the analysis of a sound, and the feature value is then formed from the two similarity values, for example by subtracting the similarity value for the foreign voice from that of the wearer's own voice. The feature value is then lower for a foreign voice than for the wearer's own voice. If the feature value is below the threshold value, the sound is recognized as a foreign voice; in contrast, if the threshold is exceeded, the sound is recognized as the wearer's own voice.

The generation of the feature values is also frequently user-dependent for other sound types. Therefore, in the calibration procedure in an advantageous development, a different sound type, in particular a foreign voice, is recorded before or after the wearer's own voice is recorded. Here, too, particularly analogous to the above, a plurality of feature values are generated, on the basis of which the threshold value is set. The calibration is thus significantly improved, in particular with regard to the accuracy in the distinction between the wearer's own voice and the other sound type. For example, the mean of the two means of the two statistical distributions generated for the two sound types is set as the threshold value.

The identity of the hearing device wearer is not the only environmental condition with regard to which it is reasonable to adapt the threshold value. Of particular importance in the analysis of most sound types is their superposition with noise, often background noise or interference. In particular, it has been recognized that the generation of a feature value, i.e. in particular the classification of the sound, becomes more difficult and error-prone as the volume of noise increases. The same applies analogously to the distinction between two sound types. Therefore, in a particularly preferred configuration, and alternatively or additionally to the user-dependent setting of the threshold value, the threshold value is adjusted based on the environment by determining a noise value and setting the threshold value based on the noise value. In this way, the own-voice recognition is further optimized.

The noise value characterizes and in particular quantifies the noise. Preferably, the noise value is a level, volume, intensity or amplitude of the noise. Alternatively, the signal-to-noise ratio is suitable as a noise value. Also suitable is a typification of the noise, i.e. the assignment of the currently present sound to a specific noise type and a setting of the threshold value based on the detected noise type, the noise type then being the noise value.

Additionally or alternatively to the noise-dependent setting, any other environmental dependency may also suitably be used, but must first of all be determined and in particular quantified, in order for the threshold value to then be set on the basis thereof.

In a suitable configuration, a plurality of value ranges are defined for the noise value, to each of which a threshold value is assigned. The value range in which the noise value is located is then determined, and then the threshold value assigned to the determined value range is selected and set. In this way, each noise value is assigned a sufficiently suitable threshold value in a simple manner, so that overall the resulting assignment, for example in the form of a table, is one from which the most appropriate threshold value in a respective situation is selected and then set. This is based on the consideration that the noise value is within a certain range of values, which is now advantageously divided into a plurality of, in particular, coherent intervals in order to implement a noise-value-dependent setting of the threshold value.

For example, the noise value is a level of noise in the environment of the hearing device. The level is usually given in dB. The value range then runs, for example, from −90 to −40 dB and is divided into approximately 10 to 20 value ranges of for example 5 dB each. Each value range is then assigned a separate threshold value. During operation of the hearing device, the noise level is then measured and then that threshold value is set that is assigned to the value range in which the measured level lies. The level is measured, for example, by means of a noise estimator, for example based on a "minimum statistics" approach.

Threshold values may be assigned to the value ranges takes place, for example, in the context of a fitting session with the acoustician or by the hearing device wearer, e.g. as part of a calibration procedure. It is essential, in particular, that defined noise values are available or at least may be reliably measured. The assignment may be made via a pure calibration measurement and then be provided as a table and stored on the hearing device, or the assignment may be made through a functional assignment, which is for example an approximation to the result of the calibration measurement. In the latter variant, for example, the upper and lower limits for the threshold value are assumed, in particular an upper limit for low levels, e.g. below −75 dB, and a lower limit for high levels, e.g. above −60 dB, and extrapolation is performed between those. In this case, it is advantageous to determine only a suitable upper limit and a lower limit, as well as those value ranges over which extrapolation is then carried out.

In an expedient configuration, the threshold value is recalibrated recurrently during normal operation of the hearing device, in particular as described above with regard to the user-dependent determination of the optimal threshold value. In this way, the user-dependent threshold value is calibrated in particular continuously, and over time is constantly better adapted to the current hearing device wearer. This corresponds in particular to a training operation for the hearing device, which expediently ends after a certain training period. The user-dependent threshold value is then set as a fixed value in particular.

The hearing device according to the invention has an own-voice recognition designed to carry out the method in one of the abovementioned configurations. Depending on the result of the own-voice recognition, the hearing device switches over to a suitable operating mode for the respective situation. In a variant, the switching also takes place as a result of the own-voice recognition.

Other features which are considered as characteristic for the invention are set forth in the appended claims.

Although the invention is illustrated and described herein as embodied in a method for operating a hearing device and a hearing device for detecting own voice based on an individual threshold value, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
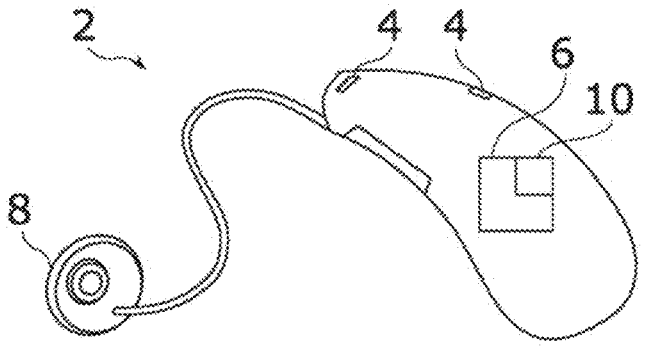
FIG. 1 is an illustration of a hearing device with own-voice recognition.

Referring now to the figures of the drawings in detail and first, particularly to FIG. 1 thereof, there is shown a hearing device 2. This device is configured in this case as a BTE device and is worn by a user behind the ear. In one variant, the hearing device 2 is an ITE device and is worn in the ear. Other types of hearing devices are also suitable. The hearing device 2 has a microphone 4 for recording sounds from the environment of the hearing device 2. A recorded sound is processed as a signal in a control unit 6 of the hearing device 2 and is processed for output via a loudspeaker 8. Usually there is an amplification of the signal, i.e. the sound.

The hearing device further has an own-voice recognizer 10, which in the exemplary embodiment shown is part of the control unit 6. The control unit 6, the own-voice recognition 10, the microphones 4 and the loudspeaker 8 are suitably connected together. In addition, the hearing device 2 may be operated in different operating modes that may be switched between by means of the control unit 6 or the own-voice recognizer 10. The own-voice recognizer 10 analyzes the recorded sounds and assigns them to certain sound types G1, G2, for example the "own voice" sound type G1 or the "foreign voice" sound type G2. Depending on the detected sound type G1, G2 a suitable operating mode is then switched to. For detection, the own-voice recognizer 10 generates a feature value M and compares it with a threshold value S to decide which of the two sound type G1, G2 the analyzed sound is. This will be described in greater detail below in connection with FIGS. 2 and 3.

Figure 2:
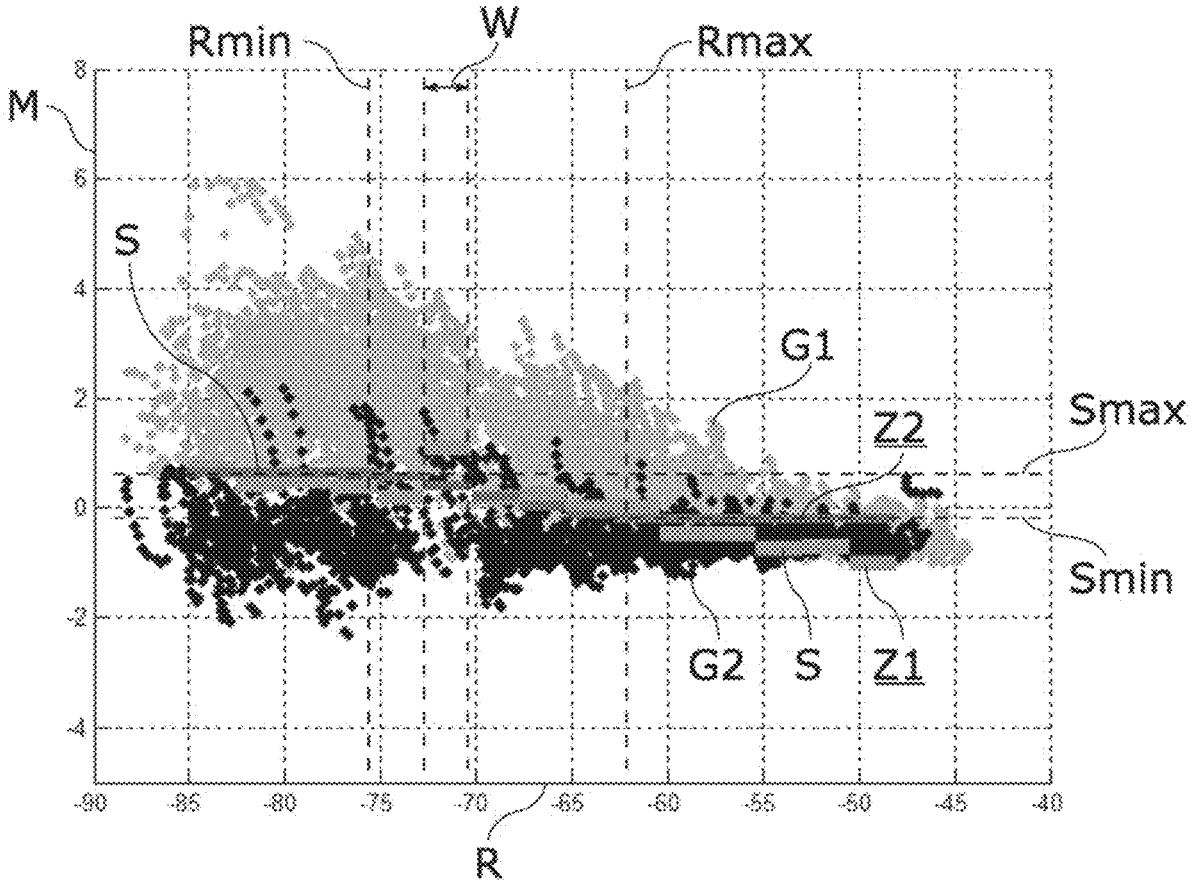
FIG. 2 is a graphical representation of the results of a measurement for the recognition of a hearing device wearer's own voice.
Figure 3:
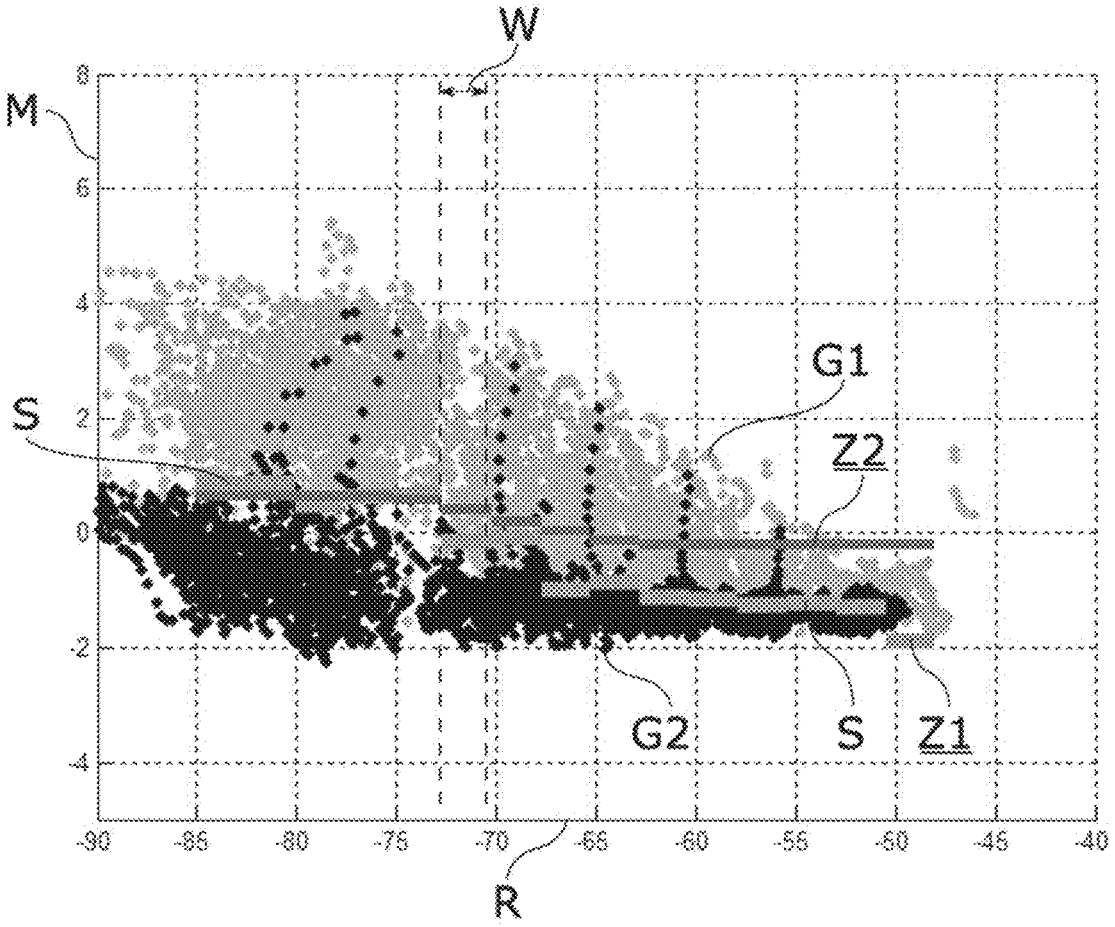
FIG. 3 is a graphical representation of the results of another measurement to recognize a hearing device wearer's own voice.

FIGS. 2 and 3 respectively show results of a measurement in which a sound was recorded and analyzed several times in succession. Two different sound types G1, G2 were used, namely the hearing device wearer's own voice and a foreign voice. The own-voice recognizer 10 of the hearing device 2 first analyzes the recorded sound with the goal of assigning a feature value M to it that provides information as to whether the sound is of one or the other of the sound types G1, G2. In the present case, this was realized by a filter pair, with two filters having different filter profiles. The filters are configured in such a way that one filter attenuates the wearer's own voice as much as possible and the other filter does the same to the foreign voice. By comparing the two different attenuations for the same sound, a feature value M is generated.

The multiple feature values M, which were recorded in the course of the measurements, are shown in FIGS. 2 and 3 and are plotted against a noise value R, which here is the level of the noise in the environment. The noise value is given here in decibels (dB). The noise value R is measured, for example, by means of a noise estimator. The feature values M are also each assigned to one of two groups, depending on which sound type G1, G2 was actually presented to the hearing device. In this case, the feature values M generated in the analysis of the wearer's own voice as sound type G1 are shown in light gray, and the feature values M generated in the analysis of the foreign voice as sound type G2 are shown in black. The measurements of FIGS. 2 and 3 differ because they show results for different hearing device wearers, i.e. at least the wearer's own voice is different.

FIGS. 2 and 3 show clearly that in the presence of a foreign voice, a smaller feature value M is typically generated than when the wearer's own voice is present. This makes it possible to set a threshold value S with which a specifically generated feature value M is compared in order to determine which sound type G1, G2 is present. In the exemplary embodiment, a sound is recognized by the own-voice recognizer 10 as the wearer's own voice when the feature value M is greater than the threshold value S, and is recognized as a foreign voice when the feature value M is less than the threshold value S.

Conventionally, only a fixed threshold value S is used for comparison to the feature value M in any situation and environment. As is apparent from FIGS. 2 and 3, however, this may be insufficient. Rather, it is apparent that the use of different threshold values S in different environments is reasonable. A first environmental dependency is that the generation of the feature value M is strongly dependent on the noise value R. For low noise values R, comparatively large feature values M are still generated for the wearer's own voice, but with a larger noise value R, the difference with respect to the feature values M of the foreign voice is significantly lower. Therefore, a smaller threshold value S is advantageously selected for larger noise values R.

FIG. 2 shows the optimal threshold values S for individual ranges W of the noise value R, in particular as gray horizontal bars. As a result, a threshold value S is effectively assigned to a specific value range W, so that the overall result is an assignment Z1, in the manner of a table. The hearing device 2 then determines a feature value M for a sound just after it is recorded and additionally determines the environment, in this case the noise value R, i.e. effectively the level or volume of the noise that is superposed on the sound. Before comparison with the feature value M, the threshold value S is then set environment-dependently, in particular to the threshold value S assigned to the value range W in which the determined noise value R lies. As a result, the feature value M is compared with a threshold value S adapted to the given situation, and an optimal result is achieved with respect to distinguishing between the wearer's own voice and the foreign voice.

Instead of the table-like assignment Z1 of optimal threshold values S to value ranges W, a simplified assignment Z2 may alternatively be used. FIG. 2 also shows such an assignment, as a dark gray, stair-like line. For the sake of simplification, it is assumed here that below a low noise value Rmin, a maximum threshold value Smax is sufficient, and above a high noise value Rmax a minimum threshold value Smin is sufficient. The threshold values S between these points is extrapolated here according to a linear relationship with respect to the selected representation. Overall, the simplified assignment Z2 results in a kind of smoothing of the assignment Z1 with the optimal threshold values S. In variant, the assignment Z2 is stored as a simple table; alternatively, a function is stored for the calculation.

Comparing FIGS. 2 and 3, a further environmental dependency of the feature values M becomes clear: the identity of the hearing device wearer. In FIG. 3, and also in FIG. 2, an assignment Z1 is shown of optimal threshold values S to certain value ranges W, as gray horizontal bars. Additionally, the same simplified assignment Z2 from FIG. 2 is entered in FIG. 3, again as a dark gray, stair-like line. Upon comparison of the simplified assignment Z2, which was determined for the hearing device wearer from FIG. 2, with the optimal threshold values S for the other hearing device wearer of FIG. 3 according to the assignment Z1, it is immediately apparent that the assignment Z2 determined in FIG. 2 is not optimal in FIG. 3. Therefore, advantageously, the threshold value S is also set user-dependently, i.e. depending on the identity of the hearing device wearer.

Overall, the threshold value S is thus preferably adjusted in an environment-dependent manner in two ways, namely both user-dependently and also based on the noise value R measured at a given time. It is then expediently determined, in a calibration procedure, which specific threshold value S will be set (i.e. one or both of the assignments Z1, Z2), i.e. which threshold values S are available for selection. This calibration procedure is performed either as part of a fitting session with the acoustician, by the hearing device wearer, automatically by the hearing device in the course of online optimization, or a combination thereof.

In order to determine an optimal threshold value S for a given hearing device wearer and a specific noise value R, the measurements described above with respect to FIGS. 2 and 3 are particularly suitable. In this case, sounds of a known sound type G1, G2 are analyzed and the feature values M determined in that process are used as typical feature values M in order to determine a suitable threshold value S. If two different sound types G1, G2 are used, then in consequence, for example, two different statistical distributions of feature values M are determined and then a threshold value S is selected that is between them. However, it is also conceivable to use only one sound type G1, G2. In a variant, the calibration is performed by using previously known sound types G1, G2, so that the correct assignment is trained. In another variant, the calibration is carried out in the normal operation of the hearing device 2 by generating feature values M in limited periods of between a few seconds and a few tens of seconds, subject to the assumption that the extrema of the feature values M determined in each period may be assigned with sufficient certainty to a specific sound type G1, G2. For example, it is assumed that a maximum feature value M was generated by the wearer's own voice and a minimum feature value M was generated by a foreign voice. These extrema are then used to establish an optimal threshold value S, which may be further adjusted and expediently used in further operation of the hearing device 2 by continuous calibration.

The following is a summary list of reference numerals and the corresponding structure used in the above description of the invention:

2 Hearing device

4 Microphone

6 Control unit

8 Loudspeaker

10 Own-voice recognition

G1, G2 Sound type

M Feature value

R Noise value

Rmin Low noise value

Rmax High noise value

S Threshold value

Smin Minimum threshold value

Smax Maximum threshold value

W Value range

Z1, Z2 Assignment

The invention claimed is:

1. A method for operating a hearing device, which comprises the steps of:

recording a sound by means of a microphone;

analyzing the sound with regard to its similarity with a hearing device wearer's own voice;

generating a feature value that indicates an extent to which the sound is similar to the hearing device wearer's own voice, the hearing device wearer's own voice is a sound type;

comparing the feature value with a threshold value, the threshold value is determined user-dependently and is set as an individual threshold value by determining the threshold value via a calibration procedure wherein the hearing device wearer's own voice is recorded and a plurality of individual feature values are generated, and finally the individual threshold value is set based on the individual feature values;

detecting the sound as the hearing device wearer's own-voice depending on whether the feature value is above or below the threshold value;

switching the hearing device between a plurality of operating modes depending on whether the sound was recognized as the hearing device wearer's own voice; and wherein the generation of the feature value takes place by means of a filter pair, wherein a first filter of the filter pair is configured for a maximum attenuation of the hearing device wearer's own voice and a second filter of the filter pair is configured for a maximum attenuation of a foreign voice.

2. The method according to claim 1, which further comprises calibrating the threshold value by determining maximum and minimum feature values over a limited period of time and setting the threshold value between the minimum and maximum feature values.

3. The method according to claim 1, which further comprises recalibrating the threshold value recurrently during normal operation when a hearing device wearer is using the hearing device.

4. The method according to claim 1, which further comprises additionally analyzing the sound with regard to its similarity with at least one other sound type, in addition to its similarity with the hearing device wearer's own voice.

5. The method according to claim 4, wherein the other sound type is a foreign voice, which is disposed in front of a hearing device wearer.

6. The method according to claim 1, wherein in the calibration procedure, a different sound type, namely a foreign voice, is recorded before or after the recording of the hearing device wearer's own voice, and a plurality of further feature values are also generated and the threshold value is set based on them.

7. The method according to claim 1, which further comprises adjusting the threshold value based on environmental conditions, by determining a noise value and setting the threshold value based on the noise value.

8. The method according to claim 7, which further comprises:

defining a plurality of value ranges for the noise value, to each of which an individual threshold value is assigned;

determining a value range in which the noise value lies; and selecting and setting the individual threshold value that is assigned to the value range determined.

9. The method according to claim 1, which further comprises calibrating the threshold value during normal operation by recurrently determining the noise value and calibrating the threshold value on that basis.

10. A hearing device, comprising:

a microphone for receiving a sound;

a controller having an own-voice recognizer configured in such a way that the sound is analyzed with regard to its similarity with a hearing device wearer's own voice, said controller programmed to:

generate a feature value that indicates how closely the sound is similar to the hearing device wearer's own voice, the hearing device wearer's own voice is a sound type;

compare the feature value with a threshold value, the sound is detected as the hearing device wearer's own voice depending on whether the feature value is above or below the threshold value;

switch between a plurality of operating modes depending on whether the sound was recognized as the hearing device wearer's own voice;

determine the threshold value user-dependently and being set as an individual threshold value by determining the threshold value by means of a calibration procedure in which the hearing device wearer's own voice is recorded and a plurality of individual feature values are generated, and in which ultimately the individual threshold value is set based on the individual feature values: and wherein the generation of the feature value takes place by means of a filter pair, wherein a first filter of the filter pair is configured for a maximum attenuation of the hearing device wearer's own voice and a second filter of the filter pair is configured for a maximum attenuation of a foreign voice.

* * * * *